US008813653B2

(12) United States Patent
Izumi et al.

(10) Patent No.: US 8,813,653 B2
(45) Date of Patent: Aug. 26, 2014

(54) RAIL-GUIDED CART SYSTEM AND BRANCHING CONTROL METHOD FOR A RAIL-GUIDED CART SYSTEM

(75) Inventors: Takanori Izumi, Inuyama (JP); Takahiro Honjo, Inuyama (JP)

(73) Assignee: Murata Machinery, Ltd., Kyoto-shi (JP)

( * ) Notice: Subject to any disclaimer, the term of this patent is extended or adjusted under 35 U.S.C. 154(b) by 69 days.

(21) Appl. No.: 13/805,290

(22) PCT Filed: Jun. 18, 2010

(86) PCT No.: PCT/JP2010/060353

§ 371 (c)(1),
(2), (4) Date: Dec. 18, 2012

(87) PCT Pub. No.: WO2011/158373

PCT Pub. Date: Dec. 22, 2011

(65) Prior Publication Data

US 2013/0092044 A1 Apr. 18, 2013

(51) Int. Cl.
*E01B 25/26* (2006.01)
*E01B 25/12* (2006.01)

(52) U.S. Cl.
USPC ..... 104/130.07

(58) Field of Classification Search
CPC ..... E01B 25/00; E01B 25/22; E01B 25/26; E01B 25/06; E01B 25/12
USPC ..... 104/130.07, 130.01
See application file for complete search history.

(56) References Cited

U.S. PATENT DOCUMENTS

| | | | | |
|---|---|---|---|---|
| 6,095,054 | A * | 8/2000 | Kawano et al. | 104/139 |
| 6,931,996 | B2 * | 8/2005 | Matsukawa | 104/96 |
| 7,392,747 | B2 * | 7/2008 | Ksyk | 104/96 |
| 7,581,502 | B2 * | 9/2009 | Nakao | 104/130.07 |
| 7,644,664 | B2 * | 1/2010 | Nakao et al. | 104/243 |
| 7,669,533 | B2 * | 3/2010 | Kyutoku | 104/130.09 |

FOREIGN PATENT DOCUMENTS

| | | |
|---|---|---|
| DE | 2163803 A1 | 6/1973 |
| JP | 2005-186843 | 7/2005 |
| JP | 2005-219643 | 8/2005 |
| JP | 2005-297683 | 11/2005 |

OTHER PUBLICATIONS

International Search Report based off PCT/JP2010/060353 filed Jun. 18, 2010.

* cited by examiner

*Primary Examiner* — Mark Le
(74) *Attorney, Agent, or Firm* — Adli Law Group P.C.

(57) ABSTRACT

A rail guided vehicle provided with a lateral pair of adjustable rollers in height is allowed to travel along travelling rails provided with a lateral pair of guide parts having long and short two vertically protruding lengths. Positions of the adjustable rollers in height may be changed such that both rollers are in an intermediate position or one is in an advanced position and the other is in a retracted position. One travelling rail branches into a first branching side and a branching/merging side, and the branching/merging side merges with a straight-travelling side of another travelling rail. When the rail guided vehicle travels on the one travelling rail toward the first branching side and travels straight on the other travelling rail, the height adjustable roller on the side opposite the branching/merging side takes the advanced position, and when travels on the branching/merging side, the rollers take the intermediate position.

8 Claims, 8 Drawing Sheets

Prior Art

RAIL-GUIDED CART SYSTEM AND BRANCHING CONTROL METHOD FOR A RAIL-GUIDED CART SYSTEM

CROSS-REFERENCE

The present application is a U.S. national phase of PCT application No. PCT/JP2010/060353, filed on Jun. 18, 2010, published as WO2011/158373, which is incorporated herein by reference in its entirety.

FIELD OF THE INVENTION

The present invention relates to branching control for a rail guided vehicle system, and in particular relates to allowing a rail guided vehicle system to travel through a branching/merging part without stopping.

BACKGROUND SECTION OF THE INVENTION

The applicant proposed a rail guided vehicle system for which it is not necessary to change the positions of adjustable rollers in height when a rail guided vehicle travels straight through a branching part (for example, Patent Literature 1: JP2005-186843A). The arrangement of a guide part on a travelling rail according to Patent Literature 1 is shown in FIG. 12. Reference numeral 7 denotes a side wall of the travelling rail. The guide part protrudes downward from the upper part of the travelling rail, reference numeral 12 denotes a protruding part where the guide part protrudes deeply downward, and reference numeral 13 denotes a normal part where the guide part protrudes to a normal position. The rail guided vehicle (not shown) is provided with right and left adjustable rollers in height, and the right and left adjustable rollers in height are raised or lowered in a manner opposite to each other. Note that, in this specification, right and left directions, or lateral direction is horizontally perpendicular to the travelling direction. In an advanced state in which the adjustable rollers in height are raised upward, the adjustable rollers in height are guided by both the protruding part 12 and the normal part 13. Also, in a retracted state in which the adjustable rollers in height are lowered, the adjustable rollers in height are not guided by either the protruding part 12 or the normal part 13. In an intermediate state in which the adjustable rollers in height are halfway between the advanced state and the retracted state, the adjustable rollers in height are guided only by the protruding part 12.

In FIG. 12, the rail guided vehicle travels from left to right in the figure, and when the rail guided vehicle travels straight through a branching/merging part, control of the adjustable rollers in height is not necessary. In a case of branching from the lower travelling rail in FIG. 12, it is necessary that the height adjustable roller on the left side with respect to the travelling direction is raised before the rail guided vehicle reaches the normal part 13*a*, and the height adjustable roller on the right side with respect to the travelling direction is raised before the normal part 13*a* terminates at the merging part. However, changing the positions of the adjustable rollers in height is not accomplished in time in a short branching/merging part, and thus the rail guided vehicle needs to stop or slow down in the branching/merging part. In JP2005-186843A, when the rail guided vehicle travels only through the branching part or the merging part, it is sufficient that the positions of the adjustable rollers in height are changed before the branching part or the merging part is reached. However, when the rail guided vehicle travels through a branching/merging part into which the branching part and the merging part are integrated, the rail guided vehicle needs to slow down or stop. Patent Literature 1 does not take in consideration travelling through the branching/merging part in which the branching part and the merging part are arranged in a continuous manner.

SUMMARY OF THE INVENTION

An object of the present invention is to eliminate the need for slowing down or stopping to change the positions of adjustable rollers in height inside a branching/merging part and to enable a rail guided vehicle to travel through the branching/merging part at a normal curve travelling speed.

The present invention is directed to a system comprising a rail guided vehicle provided with at least a lateral pair of adjustable rollers in height that may be raised or lowered, and a changing mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, intermediate guide parts having an intermediate vertical protruding length, and long guide parts having a relatively long vertical protruding length;

wherein in the intermediate position, the adjustable rollers in height are guided by the long guide parts over an entire width along a height direction, partially guided by the intermediate guide parts along the height direction, and not guided by the short guide parts, wherein in the advanced position, the adjustable rollers in height are guided by the long guide parts, the intermediate guide parts, and the short guide parts, wherein in the retracted position, the adjustable rollers in height are not guided by the intermediate guide parts or the short guide parts and are guided only by the long guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part;

wherein the guide part closer to the branching/merging route in the branching part and the guide part closer to the branching/merging route in the merging part are the intermediate guide parts, wherein both the right and left guide parts in the branching/merging route are the long guide parts, wherein at least the guide parts on sides opposite the branching/merging route are the short guide parts on the branching side and the straight-travelling side; and a controller controlling the changing mechanism such that when the rail guided vehicle travels on the one travelling rail toward the branching side and when the rail guided vehicle travels straight on the other travelling rail, the height adjustable roller on the side opposite the branching/merging route takes the advanced position and the height adjustable roller on the branching/merging route takes the retracted position, and when the rail guided vehicle travels on the branching/merging route, the right and left adjustable rollers in height take the intermediate position.

Also, the present invention is directed to a branching control method comprising a rail guided vehicle provided with at least a lateral pair of adjustable rollers in height that may be raised or lowered, and a changing mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, intermediate guide parts having an intermediate vertical protruding length, and long guide parts having a relatively long vertical protruding length;

wherein in the intermediate position, the adjustable rollers in height are guided by the long guide parts over an entire width along a height direction, partially guided by the intermediate guide parts along the height direction, and not guided by the short guide parts, wherein in the advanced position, the adjustable rollers in height are guided by the long guide parts, the intermediate guide parts, and the short guide parts, wherein in the retracted position, the adjustable rollers in height are not guided by the intermediate guide parts or the short guide parts and are guided only by the long guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part;

wherein the guide part closer to the branching/merging route in the branching part and the guide part closer to the branching/merging route in the merging part are the intermediate guide parts, wherein both the right and left guide parts in the branching/merging route are the long guide parts, wherein at least the guide parts on sides opposite the branching/merging route are the short guide parts on the branching side and the straight-travelling side, said method comprising:

a step for controlling the changing mechanism is performed by a controller before the branching/merging part is reached, such that when the rail guided vehicle travels on the one travelling rail toward the branching side and when the rail guided vehicle travels straight on the other travelling rail, the height adjustable roller on the side opposite the branching/merging route takes the advanced position and the height adjustable roller on the branching/merging route takes the retracted position;

a step for controlling the changing mechanism is performed by the controller such that when the rail guided vehicle travels on the branching/merging route, the right and left adjustable rollers in height take the intermediate position; and a step for keeping positions of the right and left adjustable rollers in height unchanged within the branching/merging part.

In the present invention, the adjustable rollers in height are simply maintained at the intermediate position when undergoing branching and merging, and the positions of the adjustable rollers in height do not need to be changed when between branching and merging. Accordingly, the rail guided vehicle travels through the branching/merging part at, for example, a curve travelling speed. In the case where the rail guided vehicle travels straight through the branching/merging part, the positions of the adjustable rollers in height are changed before the branching/merging part is reached, and because changing can be accomplished in a long straight section, the rail guided vehicle does not need to slow down. Accordingly, the rail guided vehicle can efficiently travel through a branching/merging route.

In the present invention, the guide parts have short, intermediate, and long three vertically protruding lengths, and the guide part that has the long protruding length is provided on the branching/merging side. The guide part that has the long protruding length allows the adjustable rollers in height in the intermediate state to be more reliably guided over the entire width in the height direction.

Preferably, the one travelling rail extends straight toward the branching side and curves toward the branching/merging route.

More preferably, the one travelling rail and the other travelling rail are disposed parallel to each other, and the rail guided vehicle travels in the same direction.

Most preferably, the guide parts closer to the branching/merging route are the long guide parts upstream of the branching/merging part on the one travelling rail and downstream of the branching/merging part on the other travelling rail.

Also, the present invention is directed to a system comprising a rail guided vehicle provided with at least a lateral pair of adjustable rollers in height that may be raised or lowered, and a changing mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, and long guide parts having a relatively long vertical protruding length;

wherein in the intermediate position, the adjustable rollers in height are guided by the long guide parts and not guided by the short guide parts, wherein in the advanced position, the adjustable rollers in height are guided by both the long guide parts and the short guide parts, and wherein in the retracted position, the adjustable rollers in height are not guided by the long guide parts or the short guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part, wherein the guide parts closer to the branching/merging route in the branching part, at least one of the right and left guide parts in the branching/merging route, and the guide parts closer to the branching/merging route in the merging part are the long guide parts, wherein the guide parts on a side opposite the branching/merging route are the short guide parts on the branching side;

a controller controlling the changing mechanism such that when the rail guided vehicle travels on the one travelling rail toward the branching side, the height adjustable roller on the side opposite the branching/merging route takes the advanced position and the height adjustable roller on the branching/merging route takes the retracted position, when the rail guided vehicle travels straight on the other travelling rail, the right and left adjustable rollers in height take the intermediate position, or the height adjustable roller on the side opposite the branching/merging route takes the advanced position and the height adjustable roller on the branching/merging route takes the retracted position, and when the rail guided vehicle travels on the branching/merging route, the right and left adjustable rollers in height take the intermediate position;

a first movable guide provided between the guide parts from the branching/merging route and the guide parts closer to the branching/merging route on the other travelling rail in the merging parts;

a second movable guide provided on the guide parts on the side opposite the branching/merging route on the other travelling rail in the merging part, and actuators opening the first movable guide and closing the second movable guide when the rail guided vehicle travels straight on the other travelling rail, and for closing the first movable guide and opening the second movable guide when the rail guided vehicle merges onto the other travelling rail from the branching/merging route.

In this manner also, the positions of the adjustable rollers in height do not need to be changed when between branching and merging, thus making it possible to travel through the branching/merging part at, for example, a curve travelling speed.

DETAILED DESCRIPTION OF THE INVENTION

Figure 1:
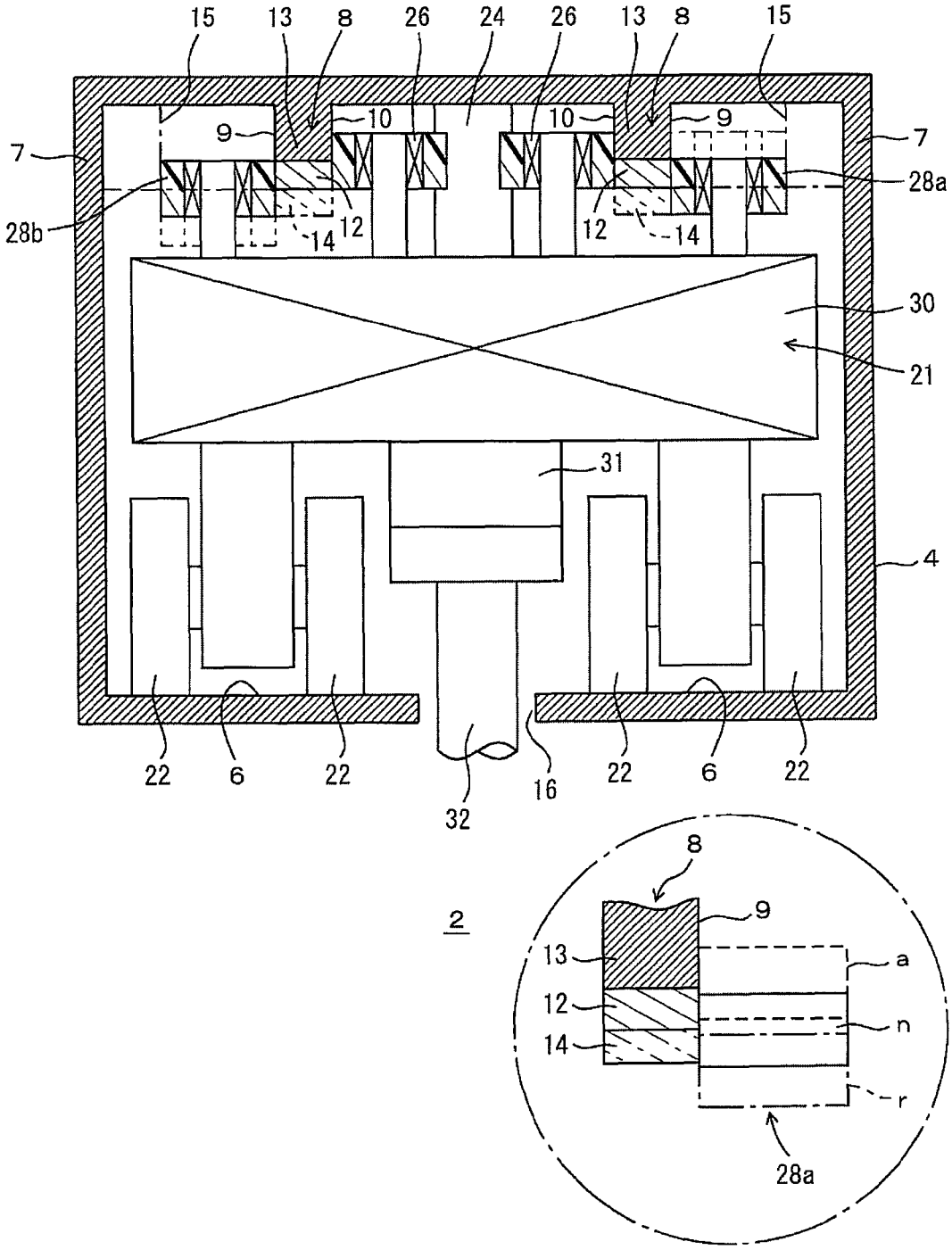
FIG. 1 is a vertical cross-sectional view of relevant portions of a rail guided vehicle system of an embodiment.

A rail guided vehicle system 2 of embodiments and modifications thereof are shown in FIGS. 1 to 10. In the figures, reference numeral 4 denotes a travelling rail, which, for example, is disposed along the ceiling space in a clean room, and supported by struts (not shown) to the ceiling of the clean room. There is a tread 6 on the lower inner surface of the tubular travelling rail 4, and this supports running wheels 22 provided on a running carriage 21 of an overhead travelling vehicle. Note that, for example, a rail guided vehicle that travels on the ground may be used in place of the overhead travelling vehicle. Reference numeral 7 denotes a side wall of the travelling rail 4. A lateral pair of guide parts 8 are provided, for example, downward from the ceiling side inside the travelling rail 4, and the overhead travelling vehicle is guided using the right and left surfaces of each guide part 8 as guide surfaces 9 and 10. The guide part 8 is arranged to be, in addition to a normal part 13 that has a normal protruding length, a protruding part 12 that protrudes downward more deeply than the normal part. In addition to the normal part 13 and the protruding part 12, a most protruding part 14 that protrudes more deeply than the protruding part 12 may be provided. In FIG. 1, the normal part 13, the protruding part 12, and the most protruding part 14 are shown one on top of the other, and sectioned by hatching or the like. In the embodiments, a height adjustable roller 28 and a fixed roller 26 are provided on the overhead travelling vehicle, but providing a guide surface 15 that guides the height adjustable roller 28 from the side opposite the guide part 8 can make the fixed roller 26 unnecessary. There is a hole 16 between the treads 6 and 6 in the bottom part of the travelling rail 4.

The overhead travelling vehicle 20 will now be described. The running carriage 21 of the overhead travelling vehicle 20 is disposed inside the travelling rail 4, and the running wheels 22 are following wheels supported by the tread 6. Reference numeral 24 denotes a driving wheel that travels while being in contact with the ceiling surface between the guide parts 8 and 8. Reference numeral 26 denotes, for example, right and left fixed rollers that have the same height position and are guided by the guide surfaces 10. Reference numeral 28 denotes adjustable rollers in height that are provided, for example, as a pair on the outer sides in the lateral direction of the guide parts 8, and have three height positions, i.e., an intermediate position, an advanced position, and a retracted position. In FIG. 1, the intermediate position of the adjustable rollers in height 28 is indicated by a solid line, and the advanced position and the retracted position are indicated by a dashed line. Reference numeral 30 denotes a changing mechanism that changes the states of the adjustable rollers in height 28. The adjustable rollers in height 28 are in three states, i.e., right and left adjustable rollers in height 28*a* and 28*b* are both in an intermediate state n; the right height adjustable roller 28*a* is in an advanced state a and the left height adjustable roller 28*b* is in a retracted state r; and conversely, the right height adjustable roller 28*a* is in a retracted state r and the left height adjustable roller 28*b* is an advanced state a.

When in the intermediate state n, the adjustable rollers in height 28 are guided only by the protruding parts 12 and the most protruding parts 14 and not guided by the normal parts 13. There is a gap between the bottom surface that is the farthest protruding part of the normal part 13 and the upper surface of the height adjustable roller 28 in the intermediate state n, and the height adjustable roller 28 can pass under the normal part 13. The height adjustable roller 28 in the advanced state a is guided by all the normal part 13, the protruding part 12, and the most protruding part 14. The height adjustable roller 28 in the retracted state r is not guided either by the normal part 13 or the protruding part 12, and because the upper surface of the height adjustable roller 28 is lower than the bottom surface of the protruding part 12, the height adjustable roller 28 can pass under the normal part 13 and the protruding part 12, and it is guided only by the most protruding part 14. The fixed roller 26 is always guided by the guide part 8 except for a gap between the guide parts 8 and 8. Reference numeral 31 denotes a travelling controller that controls the driving wheel 24 and the changing mechanism 30. The area enclosed within a dashed line at the lower right of FIG. 1 shows, using the height adjustable roller 28*a* as an example, the relationship between the guide part 8 and the height adjustable roller 28*a* in three states, i.e., intermediate state n, advanced state a, and retracted state r. Note that, as described above, the height adjustable roller 28*b* is raised or lowered in a manner laterally opposite the height adjustable roller 28*a*, and the relationship between the protruding length of the guide part 8 and the height adjustable roller 28*b* in three states is the same as the height adjustable roller 28*a*.

Figure 2:
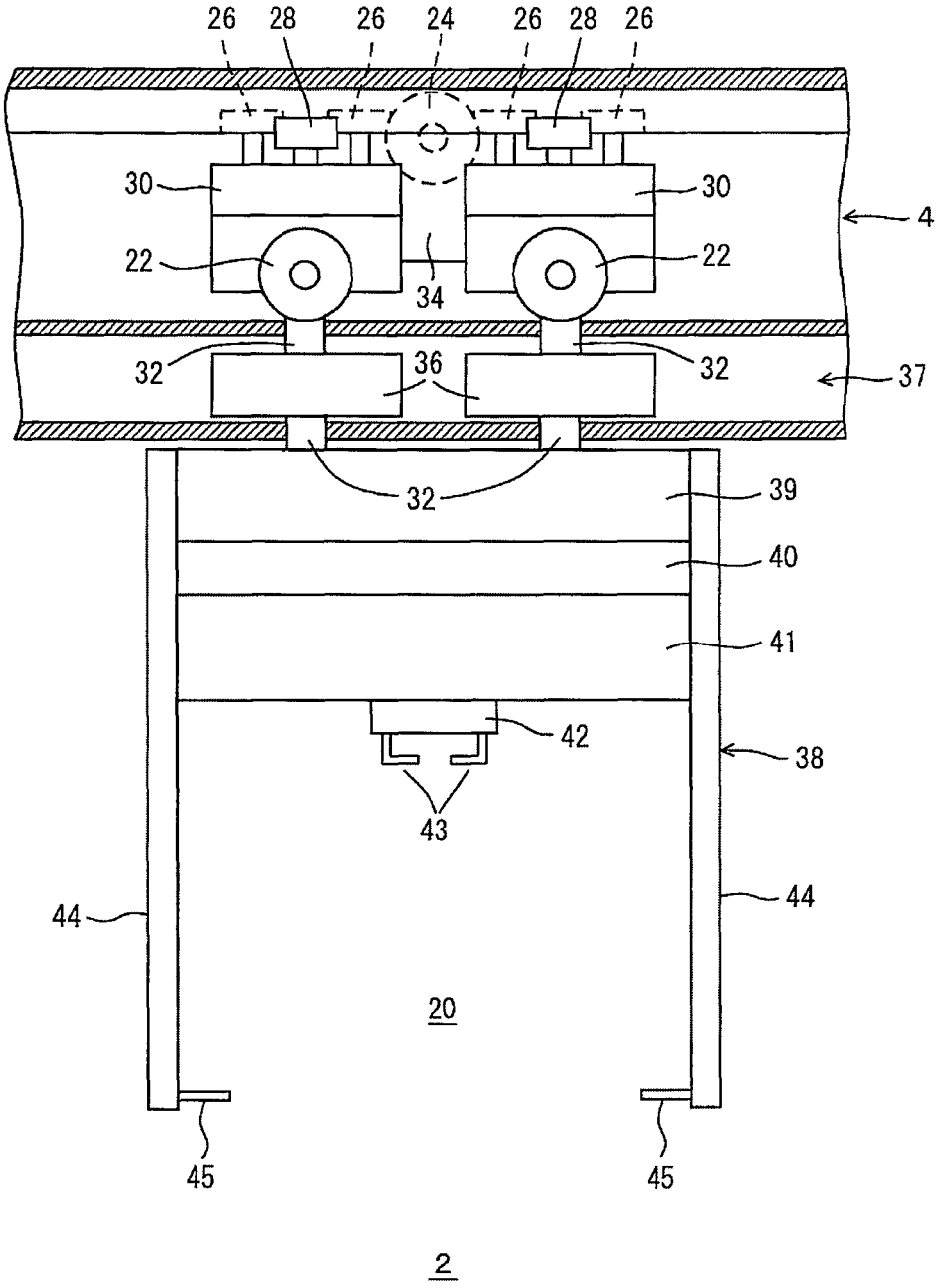
FIG. 2 is a side view of relevant portions of a rail guided vehicle system of an embodiment.

FIG. 2 shows an overall configuration of the overhead travelling vehicle 20. Reference numeral 36 denotes an electricity feeding carriage that travels within an electricity feeding rail 37 provided, for example, under the travelling rail 4 and that is subjected to non-contact electricity feeding, and reference numeral 38 denotes an overhead travelling vehicle main unit that is disposed below the rails 4 and 37 and supported by a pair of shafts 32 and 32 extending from the running carriages 21. The overhead travelling vehicle main unit 38 is provided with a lateral moving unit 39, allowing a rotational driving unit 40, a vertical driving unit 41, and a platform 42 to laterally move in a direction horizontally perpendicular to the longitudinal direction of the travelling rail 4. The rotational driving unit 40 rotates the vertical driving unit 41 and the platform 42 around a vertical shaft to arrange the orientation of articles. The vertical driving unit 41 raises and lowers the platform 42 to deliver and receive articles, and the platform 42 is provided with, for example, a pair of claws 43 that may open and close such that articles may be grabbed and released. Moreover, covers 44 and 44 are provided on the front and rear of the overhead travelling vehicle main unit 38 in the travelling direction, and retractable claws 45 are provided in the bottom parts of the covers 44 to prevent articles from falling. The configuration of the overhead travelling vehicle 20 is known per-se, and known other overhead travelling vehicles may be used.

Figure 3:
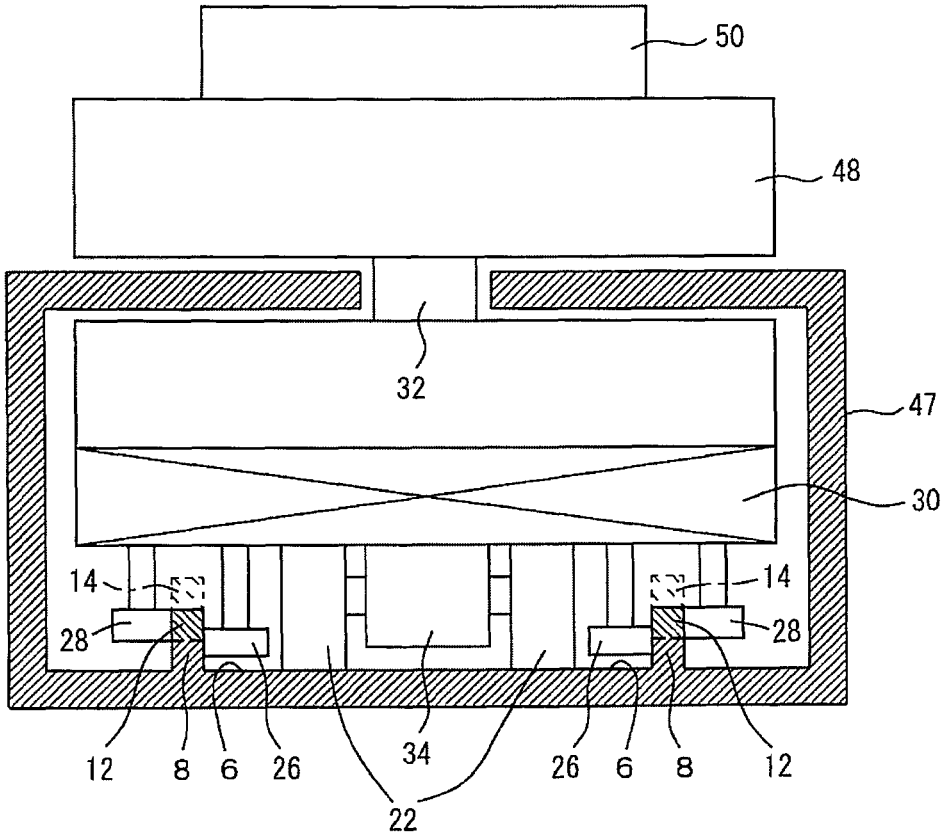
FIG. 3 is a vertical cross-sectional view of relevant portions of a rail guided vehicle system of a modified example.

In the embodiments, combinations of the overhead travelling vehicle 20 and the travelling rail 4 are described. However, the rail guided vehicle does not have to be the overhead travelling vehicle 20. Such an example is shown in FIG. 3, and unless otherwise specified, it is the same as the overhead travelling vehicle 20 of FIGS. 1 and 2. Reference numeral 47 denotes a travelling rail that allows, for example, a pair of front and rear carriages to travel while guiding them. The carriages support a lateral moving unit 48 that is composed of a selective compliance assembly robot arm (SCARA) or a slide fork vertically above via the shaft 32, and the lateral moving unit 48 allows a lifter 50 to laterally move, for example, between a rack and a station (not shown). Articles are placed on the lifter 50, and the articles are loaded and unloaded, for example, between the rack and the station by the lifter 50 that is raised and lowered. Such a rail guided vehicle also shares the same object, i.e., promptly travelling through a branching/merging part, as the overhead travelling vehicle 20. And, for example, the guide parts 8 that have three protruding lengths, i.e., normal, protruding, and most protruding, are disposed on the travelling rail 47 as in the embodiments, and the adjustable rollers in height 28 are controlled in the same manner as the embodiments.

Figure 4:
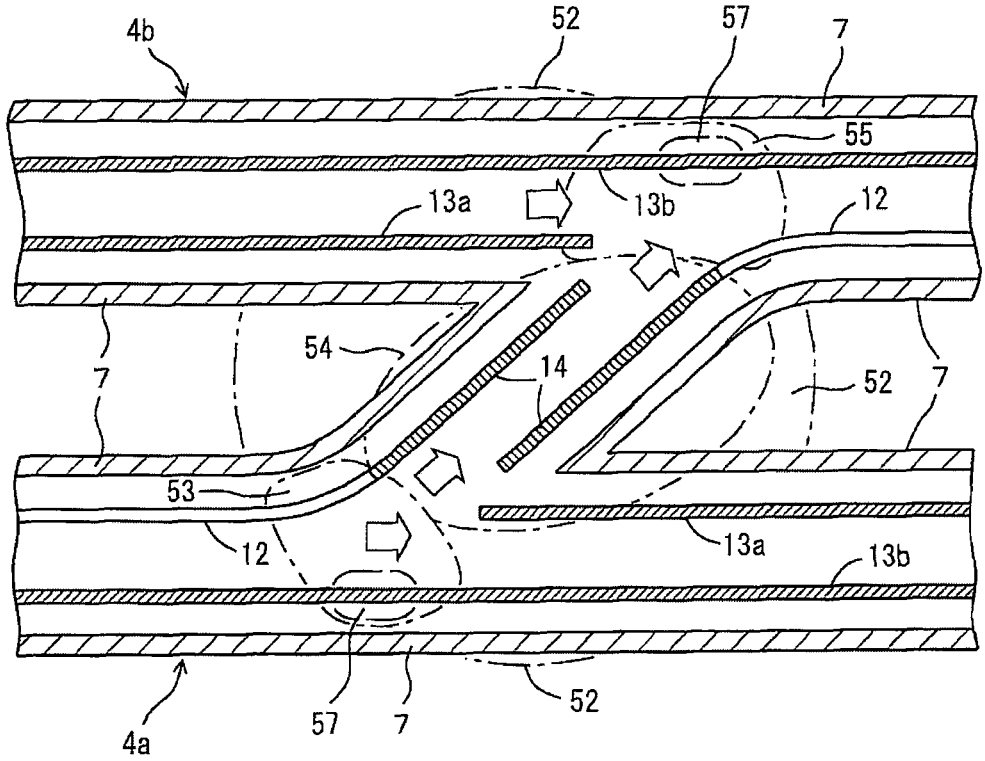
FIG. 4 is a bottom view of relevant portions showing travelling rails at a diverging/merging part in an embodiment.

FIG. 4 shows a branching/merging part 52 of an embodiment, and the overhead travelling vehicle travels only in one direction from left to right in FIG. 4. The branching/merging part 52 connects upper and lower two travelling rails 4*a* and 4*b*, and allows branching/merging travelling in which a rail branches from a lower travelling rail 4*a* and merges with an upper travelling rail 4*b*. In the branching/merging part 52, reference numeral 53 denotes a branching part, reference numeral 54 denotes a branching/merging route that is a section connecting the travelling rails 4*a* and 4*b*, and reference numeral 55 denotes a merging part, and these are arranged in the order of the branching part 53, the branching/merging route 54, and the merging part 55. The guide parts in the branching/merging route 54 are arranged to be the most protruding parts 14 to broaden the width in the height direction for guiding the adjustable rollers in height, but the protruding parts 12 may be used in place of the most protruding parts 14. In the travelling rail 4*a* before the branching/merging route 54, the guide part connected to the branching/merging route 54 is arranged to be the protruding part 12, and the guide part on the opposite side is arranged to be the normal part 13. Also, in the travelling rail 4*b* after merging with the branching/merging route 54, the guide part on the side connected to the branching/merging route 54 is arranged to be the protruding part 12, and the guide part on the opposite side is arranged to be the normal part 13. Note that, in FIG. 4, a normal part 13*a* may be replaced with the protruding part 12. A normal part 13*b* may have a normal protruding length in an area 57 under which the height adjustable roller in the intermediate state n passes, and may be replaced with the protruding part 12 elsewhere.

When travelling on the travelling rails 4*a* and 4*b* of FIG. 4, the overhead travelling vehicle that travels straight on the travelling rails 4*a* and 4*b* has the height adjustable roller on the normal part 13*b* side in the advanced state a and the height adjustable roller on the normal part 13*a* side in the retracted state r. Accordingly, in some cases it may be necessary to change the positions of the adjustable rollers in height before reaching the branching/merging part 52, and because changing the positions can be performed in a straight section that has a sufficient distance, the overhead travelling vehicle does not need to slow down. In connection with previous and next branching/merging parts, in the case where the adjustable rollers in height are already in a suitable state before reaching the branching/merging part 52, changing is not necessary.

The overhead travelling vehicle entering the branching/merging route 54 from the travelling rail 4*a* has the adjustable rollers in height in the intermediate state n, and the height adjustable roller on the side guided by the normal part 13*b* passes under the normal part 13*b* in the area 57. At this time, the height adjustable roller on the laterally opposite side is guided by the protruding part 12. Because the guide parts in the branching/merging route 54 are arranged to be the most protruding parts 14, the guide parts can guide such that the right and left adjustable rollers in height come into contact over the entire width. Note that the guide parts of the branching/merging route 54 may be arranged to be the protruding parts 12 and do not need to be arranged to be the most protruding parts 14. The overhead travelling vehicle that has the right and left adjustable rollers in height in the intermediate state n merges from the branching/merging route 54 onto the travelling rail 4*b* side, and at this time, the height adjustable roller travels so as to pass under the bottom of the normal part 13*b* in the area 57. Between branching and merging, either the right or left height adjustable roller is guided by the protruding part 12 or the most protruding part 14, and there is no need to change the positions of the adjustable rollers in height within the branching/merging part 52. Accordingly, the overhead travelling vehicle can travel through the branching/merging part 52 at an ordinary curve travelling speed.

Figure 5:
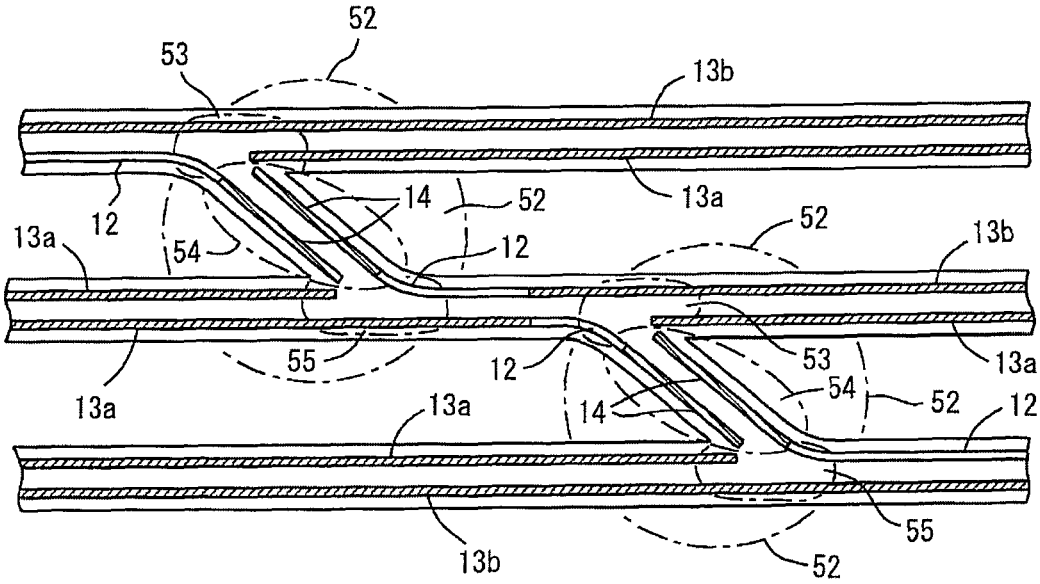
FIG. 5 is a bottom view of relevant portions showing other travelling rails.
Figure 6:
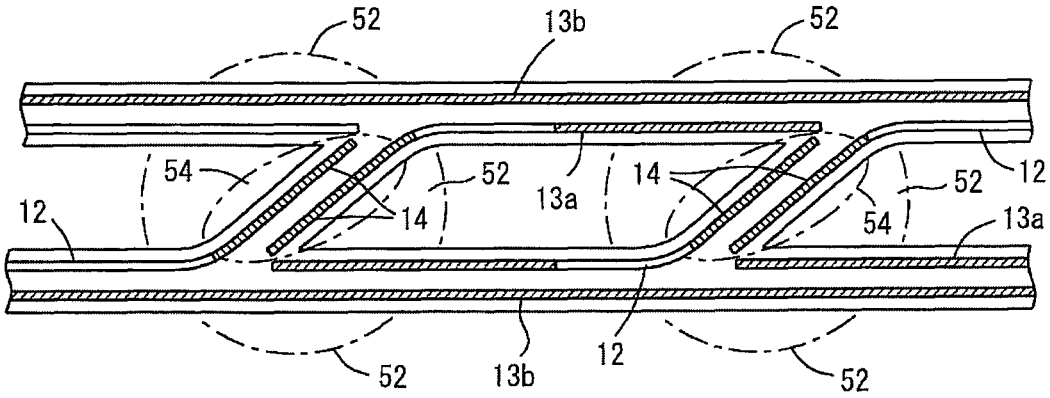
FIG. 6 is a bottom view of relevant portions showing other travelling rails.
Figure 7:
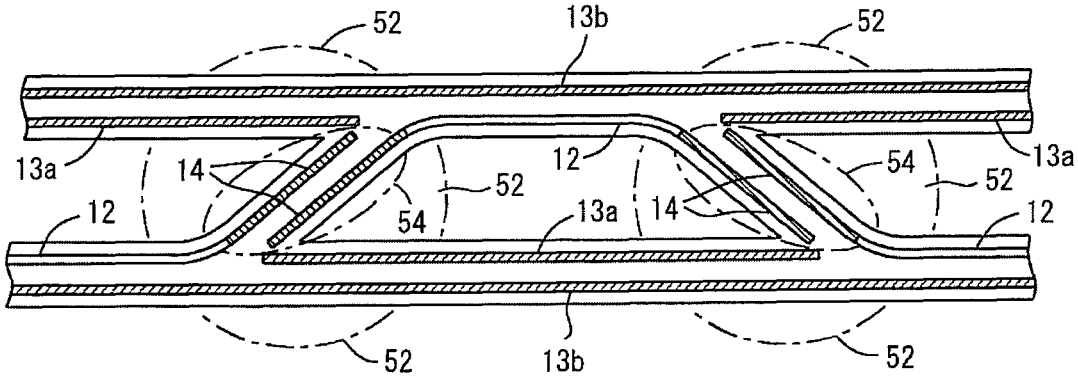
FIG. 7 is a bottom view of relevant portions showing other travelling rails.

FIGS. 5 to 7 show layouts of travelling routes in which the branching/merging part 52 is used, and the overhead travelling vehicle travels from left to right in the figures. In these layouts, the overhead travelling vehicle can travel through the branching/merging part at a curve travelling speed without stopping or slowing down, thus improving efficiency of transporting articles. When the overhead travelling vehicle travels straight through the branching/merging part, it is necessary to change the positions of the adjustable rollers in height before reaching the branching/merging part, and because changing can be performed in a straight section that is sufficiently long, the overhead travelling vehicle does not need to slow down.

Figure 8:
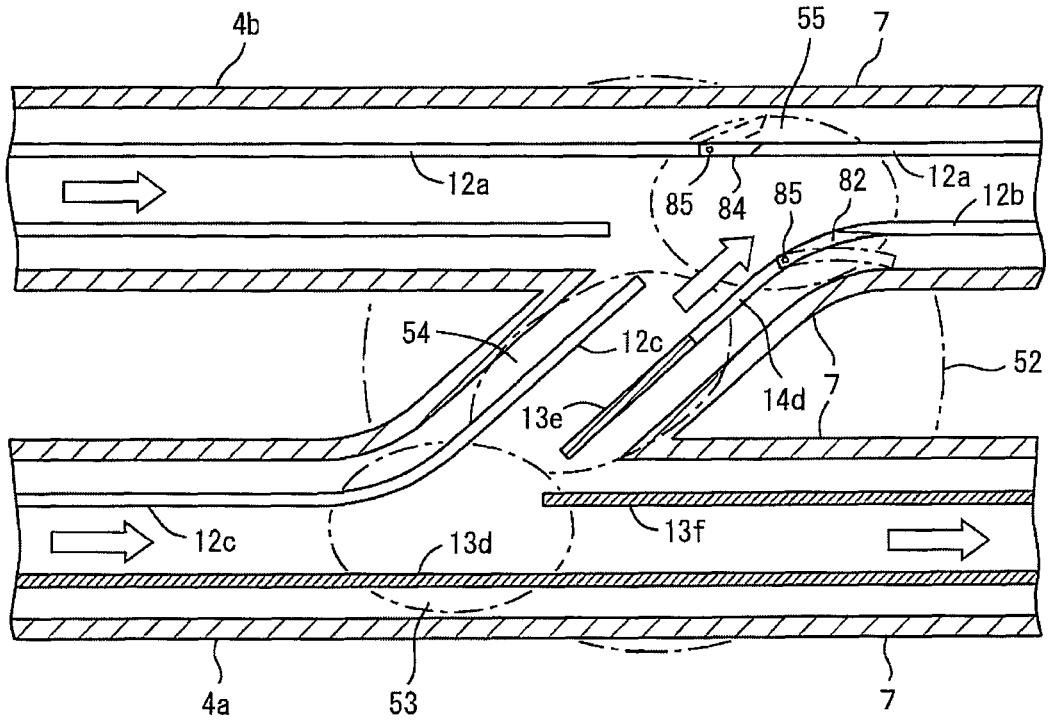
FIG. 8 is a bottom view showing travelling rails in a second embodiment.
Figure 9:
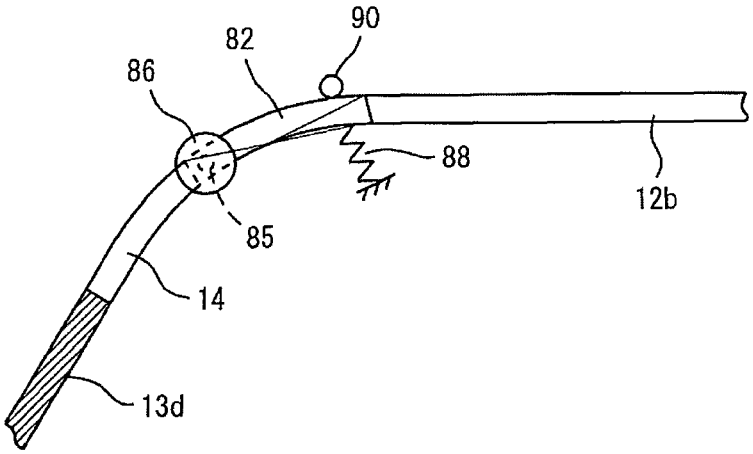
FIG. 9 is a schematic view showing a movable guide in the second embodiment.
Figure 10:
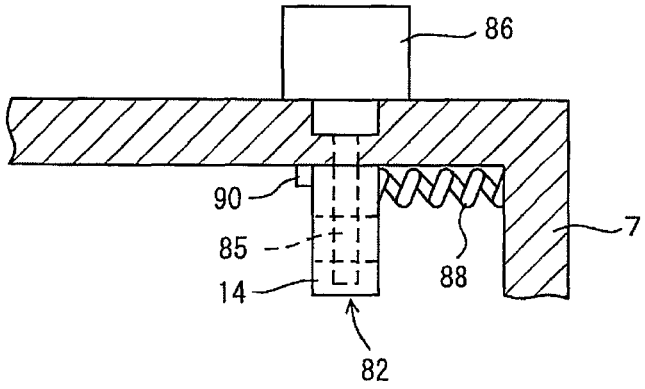
FIG. 10 is a vertical cross-sectional view of relevant portions showing the movable mechanism of the movable guide in the second embodiment.

The second embodiment is shown in FIGS. 8 to 10, and is the same as the first embodiment shown in FIGS. 1 to 7 other than the points specified in particular. In the second embodiment, movable guides 82 and 84 are provided in the merging part 55, and the movable guides 84 and 82 are provided in a position where the height adjustable roller of the overhead travelling vehicle merging from the branching/merging route 54 meets the protruding part 12*a* and in a position on the entering side of the protruding part 12*b*, respectively.

The protruding lengths of the guides are described as follows. The guide on the side opposite the branching/merging part 52 on the travelling rail 4*a* is arranged to be a normal part 13*d*, and the guide on the side connected to the branching/merging part 52 is arranged to be a protruding part 12*c*. On the branching/merging route 54, at least one of the right and left guides is arranged to be the protruding part 12, but both guides may be arranged to be the protruding parts 12. On the travelling rail 4*b*, the portion where the guide from the branching/merging part (a most protruding part 14*d*) and the movable guide 82 are connected is arranged to be the protruding part 12*b*. The overhead travelling vehicle that travels straight on the travelling rail 4*b* may be guided by the guide on the side opposite the branching/merging part 52, and for example, the height adjustable roller that is in the intermediate state n or the advanced state a is guided by the protruding part 12*a*.

The structure of the movable guide 82 is shown in FIGS. 9 and 10, and the structure of the movable guide 84 also is the same. The movable guide 82 is provided with a shaft 85 upstream in the travelling direction, and reference numeral 86 denotes an actuator, reference numeral 88 denotes an elastic member, and reference numeral 90 denotes a stopper. The elastic member 88 biases the movable guide 82 toward the stopper 90, and the actuator 86 revolves the shaft 85 and rotates the movable guide 82. The movable guide 82 is provided with a guide surface to the height of the most protruding part 14 as shown in FIG. 10, and the movable guide 84 is provided with a guide surface to the height of the protruding part 12. Instead of rotating the movable guides 82 and 84 around the axes 85, the movable guides 82 and 84 may be arranged to appear in the height direction. For example, the movable guide 82 may be raised or lowered so as to have a height between the protruding length of the most protruding part 14 and the protruding length of the normal part 13. Also, the movable guide 84 may be raised or lowered so as to have a height between the protruding length of the protruding part 12 and a protruding length smaller than the normal part 13.

In the embodiment of FIG. 8, when travelling straight on the travelling rail 4*a* provided with a branching part, the height adjustable roller on the normal part 13*d* side that is opposite the branching direction in the lateral direction is arranged to be in the advanced state a, and the height adjustable roller on the protruding part 12*c* side that is closer to the branching part in the lateral direction is arranged to be in the retracted state r. Also, when travelling straight on the travelling rail 4*b* provided with a merging part, the right and left adjustable rollers in height are both arranged to be in the intermediate state n. Also, when the adjustable rollers in height travel straight on the travelling rail 4*b* side, the movable guide 84 is closed and the movable guide 82 is opened. Closing the movable guide 84 means to connect the guide parts 12*a* and 12*a* located in the front and rear of the movable guide 84. Opening the movable guide 82 means to disconnect the most protruding part 14*a* and the protruding part 12*b*.

When branching from the travelling rail 4*a* side and merging onto the travelling rail 4*b* side, the right and left adjustable rollers in height are both arranged to be in the intermediate state n before reaching the branching/merging part 52, and guided by the protruding part 12*c* for branching, and the movable guide 84 is opened and the movable guide 82 is closed to prepare for merging onto the travelling rail 4*b*. Here, opening the movable guide 84 means to disconnect the guide parts 12*a* and 12*a* located in the front and rear of the movable guide 84. Also, closing the movable guide 82 means to connect the most protruding part 14*d* to the protruding part 12*b*. Then, between the tip of the protruding part 12*c* and the movable guide 84, the height adjustable roller on the left side with respect to the travelling direction becomes unguided, and thus the guide part on the right side with respect to the travelling direction that serves as the most protruding part 14*d* is used for guiding. Note that, in FIG. 8, the normal part 13*e* may be used in place of the protruding part 12, and the most protruding part 14*d* may be used in place of the protruding part 12. In the second embodiment as well, because the positions of the adjustable rollers in height in the branching/merging part 52 do not need to be changed, the vehicle can travel at an ordinary curve travelling speed without stopping. In the second embodiment, operation of the adjustable rollers in height is basically the same as the first embodiment. Note that the overhead travelling vehicle 20 that travels straight on the travelling rail 4*b* may have the right and left adjustable rollers in height both in the intermediate state n, or may have the height adjustable roller disposed on the guide part 12*a* side in the advanced state a and the height adjustable roller disposed on the guide part 12*b* side in the retracted state r.

In the embodiments, the vehicle can travel the branching/merging part at a curve travelling speed and does not need to slow down or stop within the branching/merging part, thus making it possible to efficiently transport articles in a layout that has the branching/merging part in which branching and merging occur in a continuous manner. Moreover, in a simple branching part and a simple merging part, the adjustable rollers in height may be controlled in the same manner as in Patent Literature 1 using the same travelling rail as in JP2005-186843A.

Figure 11:
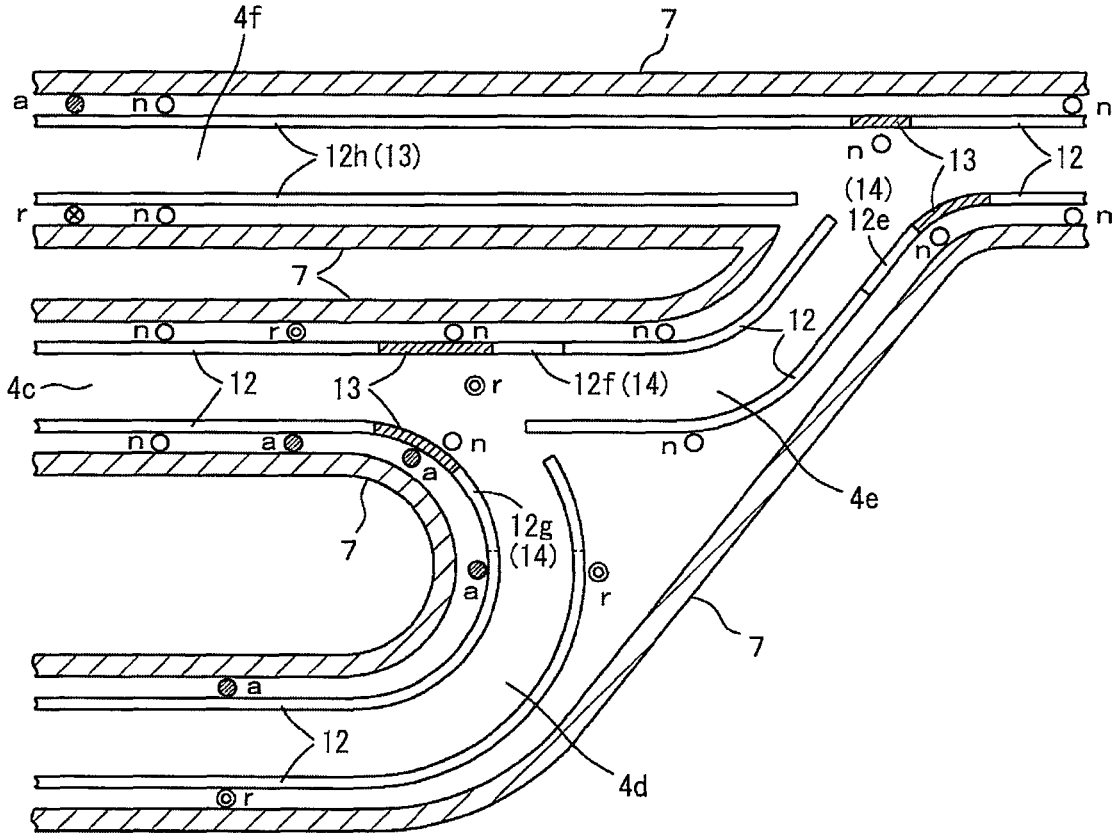
FIG. 11 is a bottom view of relevant portions showing travelling rails in a second alternative embodiment.
Figure 12:
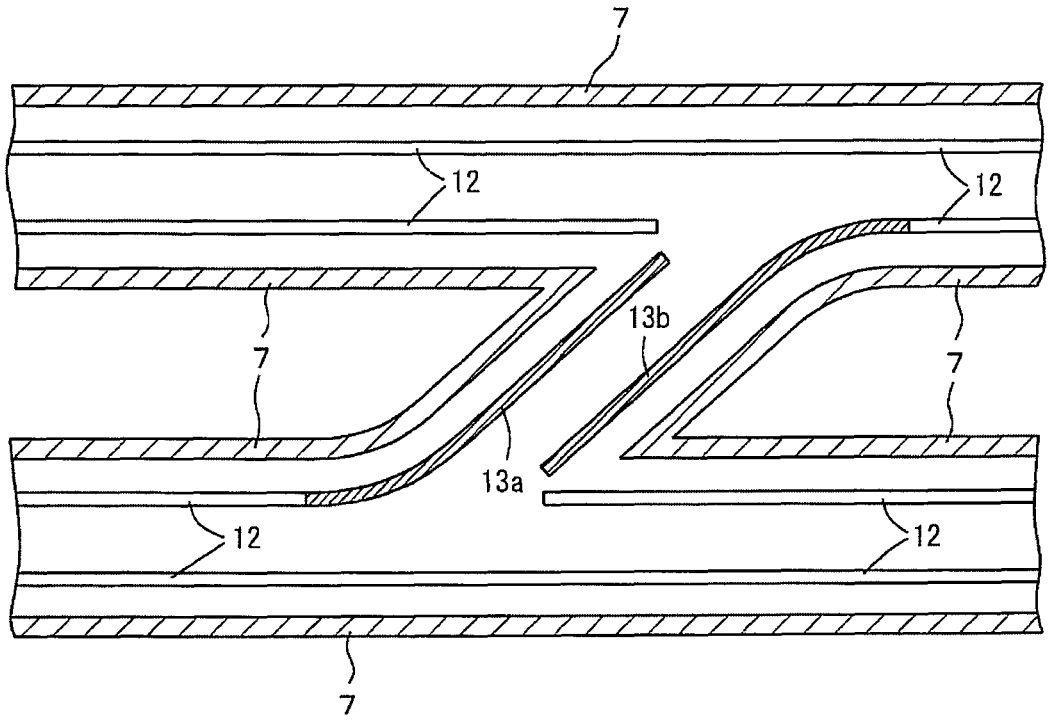
FIG. 12 is a bottom view of relevant portions showing travelling rails of a branching/merging part in a conventional example.

FIG. 11 shows a second alternative embodiment. In FIG. 11, a travelling rail 4*c* branches into a branching-side travelling rail 4*d* and a straight travelling-side travelling rail 4*e*, the branching-side travelling rail 4*d* continues without merging with another rail, and the straight travelling-side travelling rail 4*e* merges with a travelling rail 4*f*. Here, for the merger of with the travelling rail 4*f*, in order to make it unnecessary to raise or lower the adjustable rollers in height 28 on the travelling rail 4*e*, the protruding lengths of the guide parts 8 are arranged to be as shown in FIG. 11. When travelling straight from the travelling rail 4*c* to the travelling rail 4*e* and merging onto the travelling rail 4*f*, the right and left adjustable rollers in height 28 are both arranged to be in the intermediate state n. Accordingly, the right and left adjustable rollers in height 28 are guided as indicated by "○" shown in FIG. 11. When branching to the travelling rail 4*d* side, the height adjustable roller on the side closer to the branched travelling rail 4*d* in the lateral direction is arranged to be in the advanced state a (symbol ● in the figure), and the height adjustable roller on the laterally opposite side is arranged to be in the retracted state r (◎ in the figure). When travelling straight on the travelling rail 4*f*, the right and left adjustable rollers in height are both arranged to be in the intermediate state n, or the height adjustable roller on the side far from the travelling rail 4*e* is arranged to be in the advanced state a and the height adjustable roller on the near side is arranged to be in the retracted state r. Note that the protruding parts 12*e*, 12*f*, and 12*g* may be arranged to be the most protruding parts 14. Also, the protruding parts 12*h* of the travelling rail 4*f* may be both arranged to be the normal parts 13, and the height adjustable roller of the right and left adjustable rollers in height that is on the side far from the travelling rail 4*e* may be arranged to be in the advanced state a and the height adjustable roller on the near side may be arranged to be in the retracted state r.

DESCRIPTION OF REFERENCE NUMERALS

2 Rail guided vehicle system
4 Travelling rail
6 Tread
7 Side wall
8 Guide part
9, 10 Guide surface
12 Protruding part
13 Normal part
14 Most protruding part
15 Guide surface
16 Hole
20 Overhead travelling vehicle
21 Running carriage
22 Running wheel
24 Driving wheel
26 Fixed roller
28 Height adjustable roller
30 Changing mechanism
31 Travelling controller
32 Shaft
34 Travelling drive unit
36 Electricity feeding carriage
37 Electricity feeding rail
38 Overhead travelling vehicle main unit
39 Lateral moving unit
40 Rotational driving unit
41 Vertical driving unit
42 Platform
43 Claw
44 Cover
45 Claw
47 Travelling Rail
48 Lateral moving unit
50 Lifter
52 Branching/merging part
53 Branching part
54 Branching/merging route
55 Merging part
57 Area
82, 84 Movable guide
85 Shaft
86 Actuator
88 Elastic member
90 Stopper

The invention claimed is:

1. A rail guided vehicle system comprising:

a rail guided vehicle provided with at least a lateral pair of adjustable rollers in height that may be raised or lowered, and a changer mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, intermediate guide parts having an intermediate vertical protruding length, and long guide parts having a relatively long vertical protruding length;

wherein in the intermediate position, the adjustable rollers in height are guided by the long guide parts over an entire roller width along a height direction, partially guided by the intermediate guide parts along the height direction, and not guided by the short guide parts, wherein in the advanced position, the adjustable rollers in height are guided by the long guide parts, the intermediate guide parts, and the short guide parts, wherein in the retracted position, the adjustable rollers in height are not guided by the intermediate guide parts or the short guide parts and are guided only by the long guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part;

wherein the guide part closer to the branching/merging route in the branching part and the guide part closer to the branching/merging route in the merging part are the intermediate guide parts, wherein both the right and left guide parts in the branching/merging route are the long guide parts, wherein at least the guide parts on sides opposite the branching/merging route are the short guide parts on the branching side and the straight-travelling side; and a controller controlling the changer mechanism such that when the rail guided vehicle travels on the one travelling rail toward the branching side and when the rail guided vehicle travels straight on the other travelling rail, the height adjustable roller on the side opposite the branching/merging route takes the advanced position and the height adjustable roller on the branching/merging route takes the retracted position, and when the rail guided vehicle travels on the branching/merging route, the right and left adjustable rollers in height take the intermediate position.

2. The rail guided vehicle system according to claim 1, wherein the one travelling rail extends straight toward the branching side and curves toward the branching/merging route.

3. The rail guided vehicle system according to claim 2, wherein the one travelling rail and the other travelling rail are disposed parallel to each other, and the rail guided vehicle travels in the same direction.

4. The rail guided vehicle system according to claim 3, wherein the guide parts closer to the branching/merging route are the long guide parts upstream of the branching/merging part on the one travelling rail and downstream of the branching/merging part on the other travelling rail.

5. A rail guided vehicle system comprising:

a rail guided vehicle provided with at least a lateral pair of adjustable rollers in height that may be raised or lowered, and a changer mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, and long guide parts having a relatively long vertical protruding length;

wherein in the intermediate position, the adjustable rollers in height are guided by the long guide parts and not guided by the short guide parts, wherein in the advanced position, the adjustable rollers in height are guided by both the long guide parts and the short guide parts, and wherein in the retracted position, the adjustable rollers in height are not guided by the long guide parts or the short guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part, wherein the guide parts closer to the branching/merging route in the branching part, at least one of the right and left guide parts in the branching/merging route, and the guide parts closer to the branching/merging route in the merging part are the long guide parts, wherein the guide parts on a side opposite the branching/merging route are the short guide parts on the branching side;

a controller controlling the changer mechanism such that when the rail guided vehicle travels on the one travelling rail toward the branching side, the height adjustable roller on the side opposite the branching/merging route takes the advanced position and the height adjustable roller on the branching/merging route takes the retracted position, when the rail guided vehicle travels straight on the other travelling rail, the right and left adjustable rollers in height take the intermediate position, or the height adjustable roller on the side opposite the branching/merging route takes the advanced position and the height adjustable roller on the branching/merging route takes the retracted position, and when the rail guided vehicle travels on the branching/merging route, the right and left adjustable rollers in height take the intermediate position;

a first movable guide provided between the guide parts from the branching/merging route and the guide parts closer to the branching/merging route on the other travelling rail in the merging parts;

a second movable guide provided on the guide parts on the side opposite the branching/merging route on the other travelling rail in the merging part, and actuators opening the first movable guide and closing the second movable guide when the rail guided vehicle travels straight on the other travelling rail, and for closing the first movable guide and opening the second movable guide when the rail guided vehicle merges onto the other travelling rail from the branching/merging route.

6. A branching control method for a rail guided vehicle system, said rail guided vehicle system comprising:

a rail guided vehicle provided with at least a lateral pair of adjustable rollers in height that may be raised or lowered, and a changer mechanism that changes positions of the right and left adjustable rollers in height so as to bring both the right and left adjustable rollers in height to an intermediate position or bring one of the adjustable rollers in height to an advanced position and the other to a retracted position;

travelling rails, for the rail guided vehicle, provided with a lateral pair of guide parts, said guide parts comprising short guide parts having a relatively short vertical protruding length, intermediate guide parts having an intermediate vertical protruding length, and long guide parts having a relatively long vertical protruding length;

wherein in the intermediate position, the adjustable rollers in height are guided by the long guide parts over an entire roller width along a height direction, partially guided by the intermediate guide parts along the height direction, and not guided by the short guide parts, wherein in the advanced position, the adjustable rollers in height are guided by the long guide parts, the intermediate guide parts, and the short guide parts, wherein in the retracted position, the adjustable rollers in height are not guided by the intermediate guide parts or the short guide parts and are guided only by the long guide parts;

a branching/merging part connecting one travelling rail having a branching side, and another travelling rail having a straight-travelling side, and having a branching/merging route, a branching part, and a merging part;

wherein said one travelling rail branches into the branching side and the branching/merging route in the branching part, wherein the branching/merging route merges with the straight-travelling side in the merging part;

wherein the guide part closer to the branching/merging route in the branching part and the guide part closer to the branching/merging route in the merging part are the intermediate guide parts, wherein both the right and left guide parts in the branching/merging route are the long guide parts, wherein at least the guide parts on sides opposite the branching/merging route are the short guide parts on the branching side and the straight-travelling side, said method comprising:

controlling the changer mechanism being performed by a controller before the branching/merging part is reached, such that when the rail guided vehicle travels on the one travelling rail toward the branching side and when the rail guided vehicle travels straight on the other travelling rail, the height adjustable roller on the side opposite the branching/merging route takes the advanced position and the height adjustable roller on the branching/merging route takes the retracted position;

controlling the changer mechanism being performed by the controller such that when the rail guided vehicle travels on the branching/merging route, the right and left adjustable rollers in height take the intermediate position; and keeping positions of the right and left adjustable rollers in height unchanged within the branching/merging part.

7. The branching control method for a rail guided vehicle system according to claim 6, wherein the one travelling rail extends straight toward the branching side and curves toward the branching/merging route, and wherein the one travelling rail and the other travelling rail are disposed parallel to each other, and the rail guided vehicle travels in the same direction.

8. The branching control method for a rail guided vehicle system according to claim 7, wherein the guide parts closer to the branching/merging route are the long guide parts upstream of the branching/merging part on the one travelling rail and downstream of the branching/merging part on the other travelling rail.

* * * * *